United States Patent [19]

Theurer et al.

[11] Patent Number: 4,911,599

[45] Date of Patent: Mar. 27, 1990

[54] MOBILE INSTALLATION FOR LOADING, TRANSPORTING AND UNLOADING

[75] Inventors: Josef Theurer, Vienna; Johann Hansmann, Klosterneuburg; Friedrich Oellerer, Linz, all of Austria

[73] Assignee: Franz Plasser Bahnbaumaschinen-Industriegesellschaft m.b.H., Vienna, Austria

[21] Appl. No.: 334,160

[22] Filed: Apr. 6, 1989

Related U.S. Application Data

[62] Division of Ser. No. 97,760, Sep. 17, 1987, Pat. No. 4,829,907.

[30] Foreign Application Priority Data

Feb. 6, 1987 [AT] Austria ..... 247/87

[51] Int. Cl.[4] ..... E01B 29/02; E01B 29/06

[52] U.S. Cl. ..... 414/339; 104/5; 104/9; 414/501; 414/561

[58] Field of Search ..... 414/339, 340, 341, 342, 414/343, 345, 347, 348, 501, 561; 104/5, 6, 9

[56] References Cited

U.S. PATENT DOCUMENTS

| | | | |
|---|---|---|---|
| 1,283,621 | 11/1918 | Baldwin | 104/5 |
| 1,368,081 | 2/1921 | Webb | 414/394 |
| 1,879,203 | 9/1932 | Guilbert et al. . | |
| 4,096,954 | 6/1978 | Buckner . | |
| 4,099,635 | 7/1978 | Leonard et al. . | |
| 4,175,902 | 11/1979 | Herzog et al. . | |
| 4,178,123 | 12/1979 | Loeffler | 414/339 X |
| 4,190,394 | 2/1980 | Herzog et al. . | |
| 4,236,452 | 12/1980 | Theurer et al. | 104/6 X |
| 4,253,398 | 3/1981 | Theurer et al. | 414/339 X |
| 4,261,264 | 4/1981 | Theurer et al. | 104/6 |
| 4,275,659 | 6/1981 | Theurer et al. | 414/339 X |
| 4,479,750 | 10/1984 | Johnson Jr. | 414/339 X |
| 4,542,697 | 9/1985 | Cicin-Sain | 104/6 X |
| 4,606,274 | 8/1986 | Cicin-Sain et al. | 104/6 |
| 4,643,100 | 2/1987 | Valditerra | 104/6 X |
| 4,723,886 | 2/1988 | Frederking | 414/339 |
| 4,794,861 | 1/1989 | Theurer et al. | 414/339 X |

FOREIGN PATENT DOCUMENTS

| | | | |
|---|---|---|---|
| 677644 | 1/1964 | Canada | 414/339 |
| 1145065 | 3/1985 | U.S.S.R. | 104/6 |

OTHER PUBLICATIONS

"Progressive Railroading", p. 68, Feb. 78.

*Primary Examiner*—Frank E. Werner
*Assistant Examiner*—Robert S. Katz
*Attorney, Agent, or Firm*—Kurt Kelman

[57] ABSTRACT

A mobile installation for loading, transporting and unloading track parts such as ties on, in and from open top railroad cars including a train mounted for mobility along a railroad track and having a plurality of open top railroad cars. Adjacent ones of the railroad cars are coupled together and each one of the railroad cars has two parallel side walls with top edges extending in the direction of the railroad track, and two end walls, the end wals of the adjacent railroad cars defining respective gaps therebetween. A power-driven crane is provided for loading and unloading the track parts and has an undercarriage supporting the crane for mobility in the direction of the railroad track. There is also a track supporting the undercarriage of the crane for mobility above the top edges of the railroad cars in said direction. The track includes two parallel guide rails mounted on the top edges of the railroad cars and is spaced apart a distance corresponding to the gage of the crane undercarriage. The guide rails extend beyond the end walls of the railroad cars into the gaps between the adjacent cars to provide a substantially continuous track for support of the crane undercarriage along the train of cars. The power-driven crane comprises a pivotal overhead outrigger and another outrigger mounted for mobility on the guide rails, the other outrigger carries an endless conveyor band for receiving and storing the track parts. A bridge-like gantry crane is mounted for mobility on the guide rails, the gantry crane includes means for loading the track parts on, and unloading the track parts from, the endless conveyor band.

7 Claims, 2 Drawing Sheets

MOBILE INSTALLATION FOR LOADING, TRANSPORTING AND UNLOADING

REFERENCE TO RELATED APPLICATION

This is a division of our copending application Ser. No. 97,760, filed Sept. 17, 1987, now U.S. Pat. No. 4,829,907.

BACKGROUND OF THE INVENTION (1) Field of the Invention

The present invention relates to a mobile installation for loading, transporting and unloading such track parts as ties on, in and from open top railroad cars, which may be used in combination with a mobile apparatus for sequentially exchanging groups of old ties of a railroad track supporting the mobile apparatus, for example groups of one to three old ties between groups of one to three retained ties, for groups of new ties. The mobile installation comprises a train mounted for mobility along the railroad track and includes a plurality of the open top railroad cars, adjacent ones of the railroad cars being coupled together and each railroad car having two parallel side walls with top edges and two end walls, the end walls of the adjacent railroad cars defining respective gaps therebetween, a power-driven crane for loading and unloading the track parts and having an undercarriage supporting the crane for mobility in the direction of the railroad track, and a track supporting the undercarriage of the crane for mobility above the top edges of the railroad cars in this direction, the track comprising two parallel guide rails mounted on the top edges of the railroad cars and being spaced apart a distance corresponding to the gage of the crane undercarriage, the guide rails extending beyond the end walls of the railroad cars into the gaps between the adjacent cars.

(2) Description of the Prior Art

U.S. Pat. Nos. 4,175,902, dated Nov. 27, 1979, and 4,190,394, dated Feb. 26, 1980, disclose an apparatus and method for loading and unloading open top or gondola railroad cars used in the exchange of consecutive groups of ties. The apparatus comprises a train mounted for mobility along the railroad track and includes a plurality of the open top railroad cars having a considerable loading volume, adjacent ones of the railroad cars being coupled together and each railroad car having two high parallel side walls with top edges and two high end walls, the end walls of the adjacent railroad cars defining respective gaps therebetween, and a power-driven crane with booms for loading and unloading the ties and having two undercarriages supporting the crane for mobility in the direction of the railroad track. The undercarriages have pneumatic tires to enable the crane to be moved along a road or the railroad track, and the crane also has pivoted gliding feet or brackets for gripping the top edges, the relatively widely spaced top edges of the railroad cars serving as a track for moving the crane along the cars while the gliding feet grip the top edges. A cable is attached to the crane to pull the crane along the railroad cars as it is perched atop the cars. Operation of this apparatus requires great skill and a number of sometimes life-threatening manual steps. The movement of the crane between adjacent cars is particularly difficult and very time-consuming, which considerably reduces the efficiency of the operation. The crane movement along and between the cars is quite unstable, providing unsafe operating conditions and frequent interruptions. In addition, the tractor used for the crane must be specially designed to enable the crane to effectuate the required forward and rearward movements on the top edges of the gondola cars.

U.S. Pat. Nos. 4,096,954, dated June 27, 1978, and 4,099,635, dated July 11, 1978, disclose a gondola car loader and tie handler, as also described on page 68 of "Progressive Railroading", February 1978, which also uses a power-driven crane movable atop a train of gondola cars. Two beams may be pivotally mounted on the chassis of the crane at each side thereof and these pivotal beams carry two flanged wheels for guidance of the crane chassis along the top edges of the gondola cars. The spacing between the guide wheels corresponds at least to the gap between adjacent cars. Each beam is pivotal at the center thereof for rotation about a transversely extending axis and is connected to a pivoting drive so that the front beams may be swung upwardly when the crane is moved from one to the next car, the crane being advanced until the wheels of the front beams may be engaged with the top edges of the next car. The beams are then swung down while the rear beams are pivoted upwardly and then lowered again when their wheels are engaged with the top edges of the next car. The operation of this apparatus is also slow and uneconomical, the movement of the crane being unstable and, therefore, unsafe for the operating personnel. Bridging the cars is not only difficult and time-consuming but is highly accident-prone in view of the heavy weight of the crane.

The above-described mobile installations with a power-driven tie loading and unloading crane movable atop a train of gondola cars have such a low efficiency that they cannot be used economically in tie exchange operations since they would cause long sections of track to be blocked for long periods for normal train traffic.

U.S. Pat. No. 1,879,203, dated Sept. 27, 1932, discloses a train of open top railroad cars for loading, transporting and unloading bulk material. A self-propelled carriage for the bulk material runs on rails atop the cars, and a pivoted link arrangement is interposed between the rails in the gaps between adjacent cars to provide a continuous track from one end of the train to the other.

SUMMARY OF THE INVENTION

It is the primary object of the present invention to improve a mobile installation for loading, transporting and unloading such track parts as ties on, in and from open top railroad cars so that it may be operated more efficiently, simply and safely.

It is another object of this invention particularly in combination with a mobile apparatus for sequentially exchanging groups of, for example three, old ties for groups of new ties while retaining groups of, for example three, old ties between the groups of new ties for support of the mobile apparatus on the railroad track, to construct such an installation so that the multiple different operations may proceed smoothly and without interfering with each other, thus facilitating the monitoring and control of the operations. As a result, the entire renewal operation can proceed rapidly along existing track and will interfere minimally with train traffic over the track.

The above and other objects are accomplished according to the invention with a mobile installation for loading, transporting and unloading such track parts as ties on, in and from open top railroad cars, which comprises (a) a train mounted for mobility along a railroad track and including a plurality of said open top railroad cars, adjacent ones of the railroad cars being coupled together and each one of the railroad cars having two parallel side walls with top edges extending in the direction of the railroad track and two end walls, the end walls of the adjacent railroad cars defining respective gaps therebetween, (b) a power-driven crane for loading and unloading the track parts and having an undercarriage supporting the crane for mobility in the direction of the railroad track, (c) a track supporting the undercarriage of the crane for mobility above the top edges of the railroad cars in said direction, the track comprising two parallel guide rails mounted on the top edges of the railroad cars and being spaced apart a distance corresponding to the gage of the crane undercarriage, the guide rails extending beyond the end walls of the railroad cars into the gaps between the adjacent cars to provide an essentially continuous track along the train of cars, (d) the power-driven crane comprising a pivotal overhead outrigger and another outrigger mounted for mobility on the guide rails, the other outrigger carrying an endless conveyor band for receiving and storing the track parts, and (e) a bridge-like gantry crane mounted for mobility on the guide rails, the gantry crane including means for loading the track parts on, and unloading the track parts from, the endless conveyor band.

According to another aspect of the present invention, a mobile installation of the first-described type has a track comprising (1) two parallel guide rails spot-welded to the top edges of the railroad cars and being spaced apart a distance corresponding to the gage of the crane undercarriage, the guide rails extending beyond the end walls of the railroad cars into the gaps between the adjacent cars, and (2) intermediate guide rail pieces detachably connecting the guide rails of the adjacent railroad cars in said gaps whereby the guide rails with the intermediate guide rail pieces form a continuous track for support of the crane undercarriage along the train of coupled railroad cars, a transversely extending bracing rod interconnecting the detachable guide rail pieces in each gap.

Mounting an essentially continuous guide track for the undercarriage of the crane on the top edges of the open top railroad cars makes full use of the rigidity of the top edges for support of the guide rails and provides a track on which a conventional power-driven crane with its usual pivotal boom may be readily and safely supported and moved without any complex support and other auxiliary equipment. Since the guide rails project into the gaps between adjacent cars, they provide a secure and safe support and guide for moving the crane from one car to the other, even in track curves. Conventional open top or gondola cars may be used without any modifications, such as reinforcements of the top edges, since the guide rails may be simply spot-welded to the top edges. The guide track for the cranes along the top edges of the railroad cars leaves the car openings unencumbered and does not interfere with the rapid hoisting or lowering of goods from and into the cars. Thus, the cars may be used in any conventional manner as box cars operating without a crane moving along their tops.

DETAILED DESCRIPTION OF THE DRAWING

The above and other objects, advantages and features of this invention will become more apparent from the following detailed description of certain now preferred embodiments thereof, taken in conjunction with the accompanying somewhat schematic drawing wherein FIG. 1 is a side elevational view of an embodiment of a mobile installation with a train comprising two open top railroad cars and a power-driven crane movable atop the cars along the train;

DESCRIPTION OF THE PREFERRED EMBODIMENT

Figure 1:
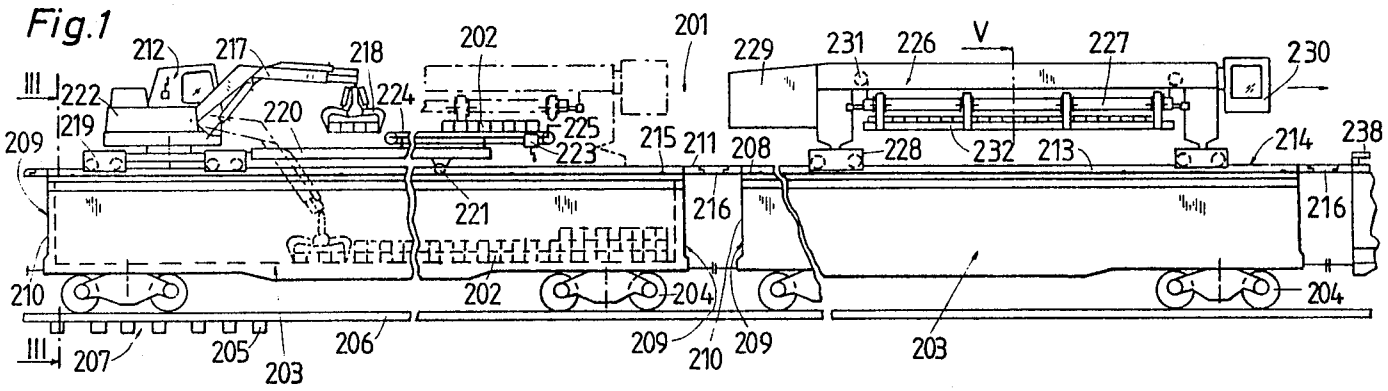
Figure 2:
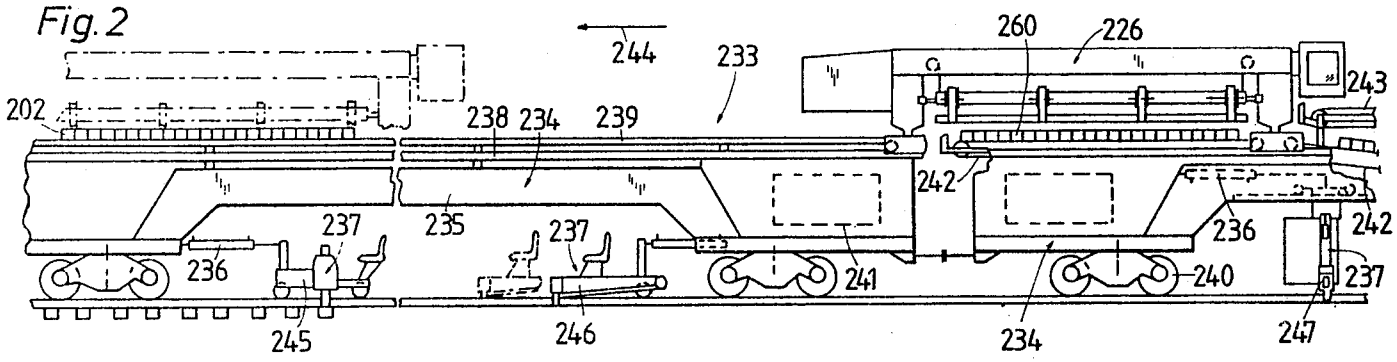
FIG. 2 is a side elevational view of a mobile tie exchange apparatus with two bridge-like work vehicles equipped with a plurality of different tie exchange operating devices, combined with a tie transport car.

Referring now to the drawing, FIGS. 1 and 2 illustrate a mobile installation 201 for loading, transporting and unloading such track parts as ties 202 on, in and from open top railroad cars 203, combined with mobile apparatus 233 for exchanging selected old ties for new ties. Mobile installation 201 comprises a train mounted for mobility in an operating direction indicated by arrow 244 along railroad track 207 consisting of rails 206 fastened to ties 205. Adjacent railroad cars 203 are coupled together and each car is supported by swivel trucks 204 on railroad track 207. The open top railroad cars have two parallel side walls with top edges 208 extending in the direction of the railroad track and two end walls 210 extending perpendicularly thereto. The end walls of adjacent railroad cars 203 define respective gaps 209 therebetween.

Track 211 supports undercarriages 219 of power-driven crane 212 for loading and unloading ties 202 for mobility in the direction of railroad track 207 above top edges 209 of railroad cars 203. This track comprises two parallel guide rails 213 mounted on top edges 208 and spaced apart a distance corresponding to the gage of crane undercarriages 219, the guide rails extending beyond end walls 210 of railroad cars 203 into gap 210 between the adjacent cars to provide a substantially continuous track 214 for support of the crane undercarriages along the train of cars. In the illustrated embodiment, the track guide rails are affixed directly to the top edges of the railroad cars by spot-welding at spot-welding points 215 spaced along the guide rails. Intermediate guide rail pieces 216 detachably connect guide rails 213 of the adjacent railroad cars in gaps 210 whereby the guide rails with the intermediate guide rail pieces form a continuous track 214 along the coupled railroad cars. Such a fixed fastening of the track guide rails directly on the top edges of the open top railroad cars provides a very secure and safe support for the heavy power-driven crane during its movement along the track while being quite cost-effective in retrofitting existing railroad cars with such a track. Gondola cars equipped with such permanently affixed guide rails may be used in standard freight operations since these guide rails in no way obstruct access to the cars through their open tops. Providing detachable connecting pieces 216 forms a continuous track for the crane along the entire train while the adjacent ends of the guide rails on adjacent cars will be far enough apart when the connecting pieces are detached so that they will not interfere with each other during standard operation of such freight cars. Thus, extending guide rails 213 beyond end walls 209 but short of the ends of the coupling buffers between the adjacent cars enables the cars to operate without any interference by the guide rails in standard freight operations while the intermediate connecting piece will provide a continuous track for the power-driven crane in the specialized operations herein disclosed.

Figures 3, 4, 5, 6, 7:
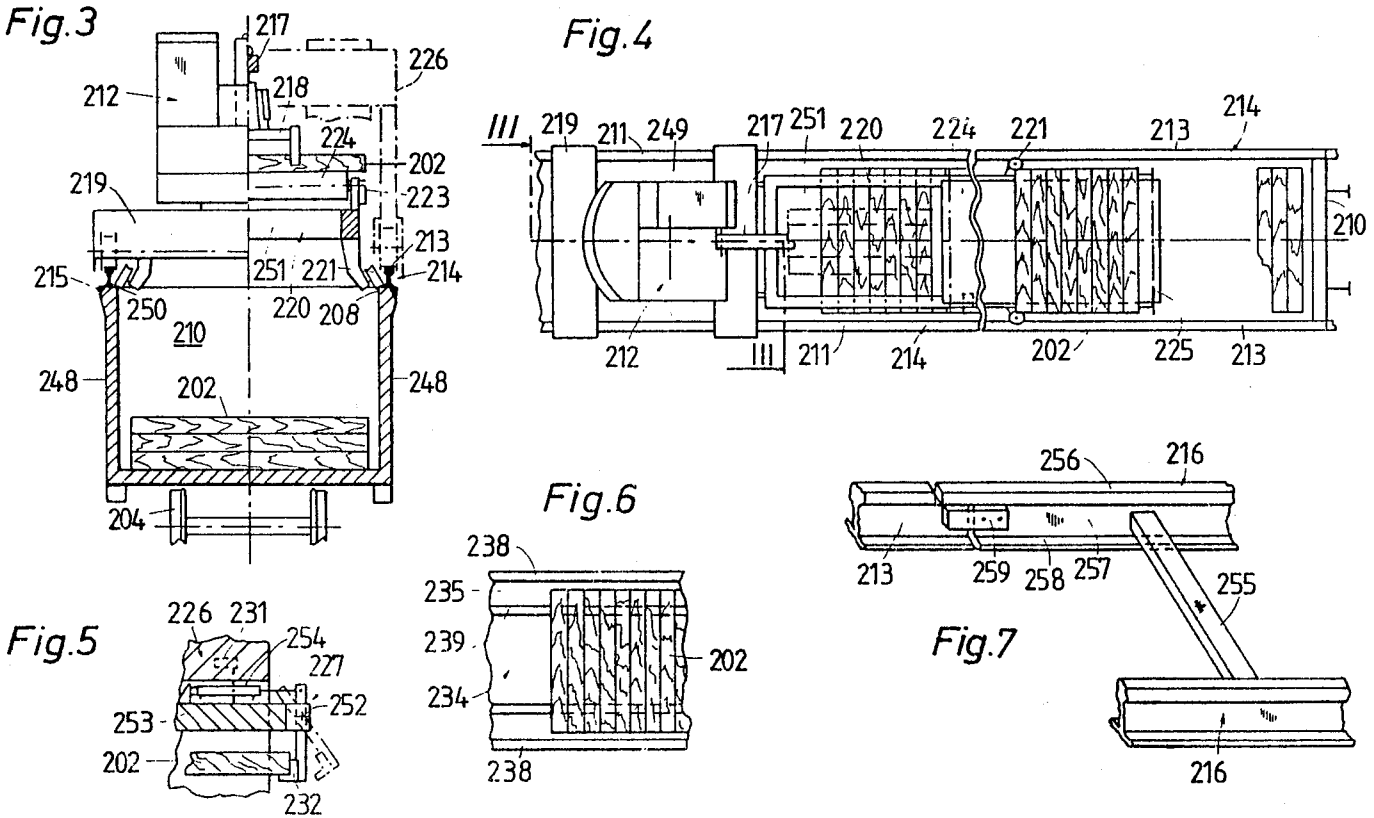
FIG. 3 is an enlarged transverse cross section along line III—III of FIGS. 1 and 4.
FIG. 4 is an enlarged top view of an open top railroad car of FIG. 1, with the power-driven crane and a longitudinally extending tie conveyor band.
FIG. 5 is an enlarged fragmentary view of the gantry crane of FIG. 1, along line V—V.
FIG. 6 is an enlarged fragmentary top view of the leading work vehicle shown in FIG. 5, illustrating the ties carried on the vehicle.
FIG. 7 is an enlarged fragmentary perspective view of a crane guide track with an intermediate track section comprising two guide rails braced by cross rod.

As best shown in FIG. 7, intermediate guide rail piece 216 preferably comprises a welded unit of two parallel guide rails interconnected by transversely extending bracing rod 255. Rail webs 257 and rail bases 258 of the guide rails of the intermediate guide rail piece are recessed from rail heads 256 at the opposite ends of the guide rails and, correspondingly, the rail heads of guide rails 213 are recessed from the rail webs and bases thereof so that rail heads 256 of the intermediate guide rail piece overlap the rail webs of guide rails 213, thus interlocking the intermediate guide rail piece with track 214. To prevent any sideways movement therebetween, detachable connecting plates 259 are used to fasten the rail webs to each other. Attachment and detachment are thus very simple.

As illustrated in FIG. 1, power-driven crane 212 comprises pivotal overhead outrigger 217 and another outrigger 220 mounted for mobility on guide rails 213. The other outrigger carries endless conveyor 224 for receiving and storing ties 202. The mobile installation further comprises bridge-like gantry crane 226 mounted for mobility on guide rails 213 and this gantry crane includes means 227 for loading the ties on, and unloading the ties from endless conveyor band 224. This combination of cranes 212 and 226 produces a very high efficiency in the loading, transporting and unloading of the ties with a minimum of uneconomical down-time. Mounting the endless tie conveyor band on the power-driven crane for the rapid conveyance of the ties assures that the conveyor band will always be at the same distance from the outrigger, regardless of the position of the crane with respect to the gondola car on which it moves. This distancing of the conveyor band from the outrigger, on the other hand, makes it possible to move the gantry crane without hindrance into a position to receive the ties from the endless conveyor.

An outer end of pivotal outrigger 217 carries tie gripping means 218 for hoisting bundles of ties 202 out of the open top railroad car and crane 212 is supported by undercarriages 219 on guide rails 213. Frame-shaped outrigger 220 has one end coupled to the crane so that this outrigger is moved along with the crane by drive 222. An opposite end of the frame-shaped outrigger is supported on the base of the guide rails by undercarriage 221. Endless conveyor 224 is mounted on an end of frame-shaped outrigger 220 remote from crane 212 for receiving ties 202 from pivotal outrigger 217 and for temporarily storing the ties. The endless conveyor band has drive 223 and a stop 225 at an end of the conveyor band remote from crane 212 for de-activating the drive. Conveyor band drive 223 is remote controllable from power-driven crane 212 by a crane operator in the cab of the crane. This enables the crane operator to drive the endless conveyor band after a suitable number of ties have been placed on one end of the conveyor band so that they are moved towards the remote end thereof. When the leading tie has reached this end, the stop will de-activate the drive and further movement of the conveyor band will be halted.

A portion of frame-shaped outrigger 220 between power-driven crane 212 and endless conveyor band 224 defines a recess whose length in the operating direction exceeds that of ties 202 while the width of this outrigger is less than the gage of track 211. A recess of the indicated dimension will enable the ties to be lifted out of the open top railroad car and to be deposited thereinto without hindrance while an outrigger of the indicated width will permit gantry crane 226 to be moved over endless conveyor band 224 for loading and unloading the ties on, and from, the conveyor band.

Further structural details of mobile installation 201 are shown in FIGS. 3 to 5. The transverse section of FIG. 3 illustrates open top railroad car 203 comprised of two side walls 248 and two end walls 210 extending perpendicularly thereto. Bottom wall 249 interconnects the side and end walls to provide a loading and storage space for ties 202. Bases 250 of guide rails 213 are spot-welded to top edges 208 of the side walls at spot-welds 215. Recess 251 in frame-shaped outrigger 220 between endless conveyor band 224 and crane 212 is shown in the top view of FIG. 4. Pivotal outrigger 217 hoists ties 202 through recess 251 and places the hoisted ties on conveyor band 224, the tie gripper 218 on pivotal outrigger 217 being pivotal about a vertical axis so that it may turn the ties from their transverse into a longitudinal position as it grips the ties in the hold of the railroad car through recess 251 and then turn them back into their transverse position to lay them on the endless conveyor band in that position.

The fragmentary view of FIG. 5 shows a detail of tie loading and unloading means 227 on the gantry crane, which comprises gripping rails 232 transversely spaced apart a distance corresponding to the length of the ties and having a length corresponding to that of endless conveyor band 224, vertically adjustable carrier 253 for the gripping rails, and drive 254 for pivoting the gripping rails on the carrier about axis 252 extending in the operating direction. The two ends of carrier 253 are attached to winches 231 for vertically adjusting the loading and unloading means on the gantry crane. Gripping rails 232 have an L-shaped cross section, the horizontal leg of the gripping rails subtending the ends of ties 202 for gripping the ties when the gripping rails are in the position shown in full lines in FIG. 5 while the ties are released when the gripping rails are pivoted by drive 254 into the position shown in dash-dotted lines in this figure. The gantry crane carries an operator's cab 230 and has its own drive 229. The combination of the hereinabove described power-driven crane 212 and gantry crane 226 provides a very effective, secure and trouble-free system for loading, transporting and unloading such track parts as ties even when a relatively long train of open top railroad cars is used.

FIGS. 2 and 6 show the combination of mobile installation 201 with mobile apparatus 233 for sequentially exchanging selected consecutive groups of at least one old tie for groups of new ties while retaining groups of at least one old tie between the selected old ties for support of the mobile apparatus on railroad track 207, for example for exchanging every third or fourth old tie for a new tie. This apparatus comprises a succession of elongated bridge-like work vehicles 234 each having two undercarriages supporting respective opposite ends of the work vehicle on the railroad track. The work vehicles are coupled to open top railroad cars 203 and a succession of different individual devices 237 are mounted respectively on the work vehicles between the undercarriages and operative to effectuate different sequential operations for exchanging the selected old ties for the new ties. Respective drives 236 connect tie exchange operating devices 237 to machine frame 235 of each work vehicle for displacing the devices with respect to the work vehicle in the operating direction along a displacement path. Mobile apparatus 233 further comprises two parallel guide rails 238 on top of machine frames 235 of the work vehicles and these guide rails are spaced apart a distance corresponding to the spacing of the two parallel guide rails 213 mounted on the top edges of open top railroad cars 203, guide rails 238 continuing track 211 supporting the undercarriages 219 of crane 212. As shown in FIG. 6, parallel ledges 239 extend on machine frame 235 between guide rails 238 for supporting ties 202. The illustrated undercarriages supporting the work vehicles on the railroad track are swivel trucks 240 and the work vehicles house power plants 241 to provide power to the various drives. Second work vehicle 234 carries conveyor means 242 for the old ties and conveyor means 243 for the new ties, which is spaced from conveyor means 242 and extends on a slightly higher level. In the operating direction indicated by arrow 244, leading tie exchange operating device 237 is a device 245 for pulling spikes and the second tie exchange operative device is a device 246 for removing tie plates. On the following work vehicle 234, first tie exchange operating device 237 is a device 247 for pulling old ties. Additional devices required for the tie exchange operation are mounted on this work vehicle and/or succeeding work vehicles, as needed, and the work vehicles may also mount means for receiving, turning and transferring the ties, as has been more fully described hereinabove.

In the operation of mobile installation 201 and mobile apparatus 233 shown in FIGS. 1 and 2, a few cars 203 are filled with new ties 202 according to need before the tie exchange operation. A few empty cars 203 are coupled to installation 201 to receive old ties. After the working site has been reached, intermediate guide rail pieces 216 are placed in position to connect the ends of guide rails 213 projecting beyond end walls 210 of adjacent railroad cars 203 so that continuous track 214 extends along the entire length of the train of cars 203 and work vehicles 234. The intermediate guide rail pieces shown in FIGS. 1 and 7 are designed for substantially straight track sections. If the apparatus operates in curves, differently shaped intermediate guide rail pieces will be used for establishing the continuous track atop the train. The train comprised of installation 201 and apparatus 233 is then continuously advanced in the direction of arrow 144. The tie exchange is effected in the above-indicated manner by tie exchange operating device 237. First, device 245 is operated to pull the spikes of, for example, every third or fourth tie of the existing track and device 246 is then operated to remove the tie plates from these ties. Old ties 205 thus detached from the rails are then withdrawn laterally from track 207 by device 247 and laid on the track. The old ties laid on the track are then received by a tie lifting device and placed on conveyor 242 for the old ties. The new ties conveyed by conveyor 243 are then inserted in the areas vacated by the old ties, the tie plates are placed in position and the rails are again fastened to the newly inserted ties, all as described hereinabove in connection with the other embodiments. Longitudinal displacement drives 236 intermittently displace tie exchange operating devices 237 relative to work vehicles 234 so that the operating devices will remain stationary for short working periods while the apparatus advances continuously.

Largely independently of this tie exchange operation, the old and new ties are transported unhindered by this operation along continuous guide track 214. To supply new ties 202, pivotal overhead outrigger 217 of power-driven crane 212 is lowered through recess 251 of frame-shaped outrigger 220 and gripping means 218 is operated to seize a bundle of, for example, four ties. Outrigger 217 is then raised and the bundle of ties is laid on conveyor band 224. While the next bundle of ties is raised, the operator on crane 212 actuates drive 223 by remote control so that the bundle of ties on conveyor band 224 is transported in the direction of stop 225 and room is made available on the conveyor band for the next bundle of ties. As soon as longitudinally extending conveyor band 224 is fully loaded with new ties 202, the operator in cab 230 on gantry crane 226 moves the gantry crane along guide track 214 over conveyor band 224 (see chain-dotted lines in FIG. 1). Winches 227 are then operated to lower hoist 227 and to pivot gripping rails 232 outwardly (see chain-dotted lines in FIG. 2). The gripping rails are then inwardly pivoted to subtend the end of ties 202 on conveyor band 224 whereby the ties are gripped and winches 227 are operated again to raise the gripped ties, whereupon gantry crane 226 is moved back along guide track 214 over railroad car 203 to work vehicle 234 where the new ties are laid on support ledges 239 (FIGS. 2 an 6). Meanwhile, old ties 260 collected on conveyor band 242 are picked up by another gantry crane 226 and are placed on a free section of tie support ledges 239. The old ties are then picked up by the gantry crane which transported the new ties, and this gantry crane is moved over railroad car 202 where gripping rails 232 are operated to release the old ties and to load them into car 203. The gantry crane is then moved forward over conveyor band 224 which meanwhile has been loaded with new ties, and this operation is repeated.

When gripping means 218 can no longer pick up new ties 202 because no new ties are within reach of pivotal outrigger 217, power-driven crane 212 is moved on its undercarriages 219 along guide track 214, which causes outrigger 220 and its conveyor band 224 supported by wheels 221 on the base of guide rails 213 to be moved along with the crane. Since wheels 221 are supported on the base of the guide rails, gantry crane 226 may move on guide rails 213 over conveyor band 224 without hindrance. For more secure guidance, the wheels of undercarriages 219 and 228 may be double-flanged wheels.

Within the scope of the present invention, various modifications may occur to those skilled in the art. For example, open top railroad cars useful for the transport not only of ties but of other goods, such as various track components, may be used only for transporting old ties previously removed in an independent operation. Thus, the mobile loading, transporting and unloading installation may be used independently of the mobile tie exchange apparatus, for instance by simply placing the new ties next to the railroad track and receiving and transporting the old ties later. The number of cranes moving atop the open railroad cars and of the conveyor units may vary widely, depending on the capacity of the railroad cars. Also, different types of conveyors, including roller conveyors instead of endless conveyor bands, may be used, particularly for handling such heavy goods as concrete ties.

What is claimed is:

1. A mobile installation for loading, transporting and unloading such track parts as ties on, in and from open top railroad cars, which comprises (a) a train mounted for mobility along a railroad track and including a plurality of said open top railroad cars, adjacent ones of the railroad cars being coupled together and each one of the railroad cars having two parallel side walls with top edges extending in the direction of the railroad track and two end walls, the end walls of the adjacent railroad cars defining respective gaps therebetween, (b) a power-driven crane for loading and unloading the track parts and having an undercarriage supporting the crane for mobility in the direction of the railroad track, (c) a track supporting the undercarriage of the crane for mobility above the top edges of the railroad cars in said direction, the track comprising (1) two parallel guide rails mounted on the top edges of the railroad cars and being spaced apart a distance corresponding to the gage of the crane undercarriage, the guide rails extending beyond the end walls of the railroad cars into the gaps between the adjacent cars to provide a substantially continuous track for support of the crane undercarriage along the train of cars, (d) the power-driven crane comprising a pivotal overhead outrigger and another outrigger mounted for mobility on the guide rails, the other outrigger carrying an endless conveyor band for receiving and storing the track parts, and (e) a bridge-like gantry crane mounted for mobility on the guide rails, the gantry crane including means for loading the track parts on, and unloading the track parts from, the endless conveyor band.

2. The mobile installation of claim 1, wherein the guide rails are spot-welded to the top edges.

3. The mobile installation of claim 1, further comprising intermediate guide rail pieces detachably connecting the guide rails of the adjacent railroad cars in said gaps whereby the guide rails with the intermediate guide rail pieces form a continuous track along the coupled railroad cars.

4. The mobile installation of claim 3, further comprising a transversely extending bracing rod interconnecting the detachable guide rail pieces.

5. The mobile installation of claim 1, wherein the endless conveyor band has a drive and a stop for deactivating the drive, the conveyor band drive being remote controllable from the power-driven crane, the guide rails have a base and the other outrigger has an undercarriage movably supported on the base of the guide rail.

6. The mobile installation of claim 1, wherein a portion of the other outrigger between the power-driven crane and the endless conveyor band defines a recess whose length in said direction exceeds that of the ties while the width of the other outrigger is less than the gage of the track.

7. The mobile installation of claim 1, wherein the loading and unloading means comprises gripping rails transversely spaced apart a distance corresponding to the length of the ties and having a length corresponding to that of the endless conveyor band, a vertically adjustable carrier for the gripping rails, and a drive for pivoting the gripping rails on the carrier about an axis extending in said direction.

* * * * *